US009368901B2

(12) United States Patent
Gicquel

(10) Patent No.: US 9,368,901 B2
(45) Date of Patent: Jun. 14, 2016

(54) SYSTEM AND METHOD FOR REDUCING PARTICULATE MATTER IN CONNECTORS FOR A WELLSITE DRILLING OPERATION

(71) Applicant: Schlumberger Technology Corporation, Sugar Land, TX (US)

(72) Inventor: Frederic Gicquel, Pennington, NJ (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 565 days.

(21) Appl. No.: 13/830,363

(22) Filed: Mar. 14, 2013

(65) Prior Publication Data

US 2014/0083719 A1 Mar. 27, 2014

Related U.S. Application Data

(60) Provisional application No. 61/704,698, filed on Sep. 24, 2012.

(51) Int. Cl.

| | |
|---|---|
| ***H01R 4/48*** | (2006.01) |
| ***H01R 13/52*** | (2006.01) |
| ***H01R 13/17*** | (2006.01) |

(52) U.S. Cl.

CPC ..... *H01R 13/52* (2013.01); *H01R 13/17* (2013.01); *H01R 13/5219* (2013.01)

(58) Field of Classification Search

CPC ..... H01R 13/15; H01R 13/17; H01R 13/18; H01R 13/187; H01R 4/48; H01R 4/4863

USPC ..... 439/816

See application file for complete search history.

(56) References Cited

U.S. PATENT DOCUMENTS

| | | | | |
|---|---|---|---|---|
| 4,600,838 | A | 7/1986 | Steinman et al. | |
| 4,721,853 | A | 1/1988 | Wraight | |
| 4,794,792 | A | 1/1989 | Flaum et al. | |
| 5,144,126 | A * | 9/1992 | Perry | G01V 5/107 250/254 |
| 5,313,504 | A | 5/1994 | Czirr | |
| 7,311,566 | B2 * | 12/2007 | Dent | H01R 13/187 439/63 |
| 2011/0266120 | A1 * | 11/2011 | Nakauchi | H01H 1/385 200/252 |

* cited by examiner

*Primary Examiner* — Vanessa Girardi
(74) *Attorney, Agent, or Firm* — Michael Dae

(57) ABSTRACT

A connector system for reducing particulate matter may include a first unit for supplying signals and a second unit for receiving and/or relaying the signals. The signals may be for power generation and/or communications. A coupling may be positioned between the first unit and second unit. The coupling may include a center pin attached to the first unit and for receiving a signal at a first potential. The coupling may further include an outer case attached to the first unit and for receiving a signal at a second potential. The coupling may also have a seal and a spring. The seal and spring may surround the outer case. The spring may engage the second unit and may pass signals between the first unit and the second unit. The spring may comprise a canted coil spring for supporting load forces and for passing electrical current.

18 Claims, 4 Drawing Sheets

SYSTEM AND METHOD FOR REDUCING PARTICULATE MATTER IN CONNECTORS FOR A WELLSITE DRILLING OPERATION

CROSS-REFERENCE TO RELATED APPLICATIONS

This application claims benefit of U.S. provisional patent application Ser. No. 61/704,698, filed Sep. 24, 2012, which is herein incorporated by reference.

DESCRIPTION OF THE RELATED ART

Some radiation generators, such as the neutron generators for the oil field services industry, are particularly limited in size and shape. These radiation generators often use high voltage power supplies. To ease manufacturing of the neutron generators and their respective power supplies, each high voltage power supply and the radiation tube for the neutron generator are usually assembled separately and connected during the last steps of the assembly.

Making a connection between the radiation tube and power supply for a neutron generator easily "breakable" allows the manufacturing and the maintenance of such systems having these two components much easier. However, separate physical components may be challenging in order to fulfill all end-use environmental requirements (space, ruggedness, etc.), such as those found in rough environments, like an oil drilling operation.

Some breakable designs employ springs which may have push buttons to disengage the two elements. In such configurations, the spring and the button usually must be "protected" behind a metal part in order to prevent corona discharge. Consequently, under shock and vibration in rough environments, like in a drilling operation, the button will usually hit and rub on internal parts of the assembly which often creates metal dust.

In other conventional solutions, the spring may be removed while the button may be substituted with a slightly oversized version made from conductive rubber. Such a conventional solution may reduce metal dust but usually such a design may create conductive rubber particulates which may have the same effect as the metal dust problem described above.

Due to these issues, other conventional solutions have been redesigned and replaced with a hardwired solution which may make the assembly thereof somewhat difficult. One main reason for the failures of the conventional designs which generate metal dust and/or conductive rubber particulates is the fact that the two parts may often move with respect to each other in high vibration/shock environments, such as in an oil drilling context. As these two parts move with respect to each other, they can easily hit and rub each other which may lead to wear and the generation of particulate materials which may contaminate the electrical environment, and in some cases, establish the potential for corona discharge or a high voltage breakdown.

SUMMARY OF THE DISCLOSURE

A connector system for reducing particulate matter may include a first unit for supplying electrical power and/or communication signals and a second unit for receiving the electrical power and/or relaying the communication signals. A breakable coupling may be positioned between the first unit and second unit. The coupling may include a center pin attached to the first unit and for receiving signals at a first potential. The coupling may further include an outer case attached to the first unit and for receiving signals at a second potential. The coupling may also have a seal and a spring. The seal and spring may surround the outer case. The spring may engage the second unit and may pass the electrical power at the second potential between the first unit and the second unit. The spring may comprise a canted coil spring for supporting load forces and for passing electrical current. However, other springs, such as, but not limited to, leaf springs, fingerstocks, and appropriately shaped wire springs (round, polygonal shape, oval shape, or others) may be employed.

The first unit may comprise a power supply for an electronic radiation generator used in an oil well drilling environment. Electronic radiation generators may use high voltages at about or above 50 kV. This high voltage power supply may be connected to a radiation tube (that may comprise a neutron tube, an x-ray tube, or other similar radiation tube). The radiation tube may be the second unit referenced above and described below. For ease of manufacturing, the high voltage power supply and the radiation tube may be assembled separately and then joined together in an insulated housing. There are several ways to connect these two subassemblies.

The inventive method and system may comprise at least one way to connect the two subassemblies, as described above, that includes the high voltage power supply and the radiation tube. The inventive connector system may be decoupled easily but it may limit any amount of dust that may be created by incidental rubbing of materials of the system during vibration. The inventive method and system may trap dust in areas of the connector which is not as sensitive to the high voltage environment.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

Figure 1A:
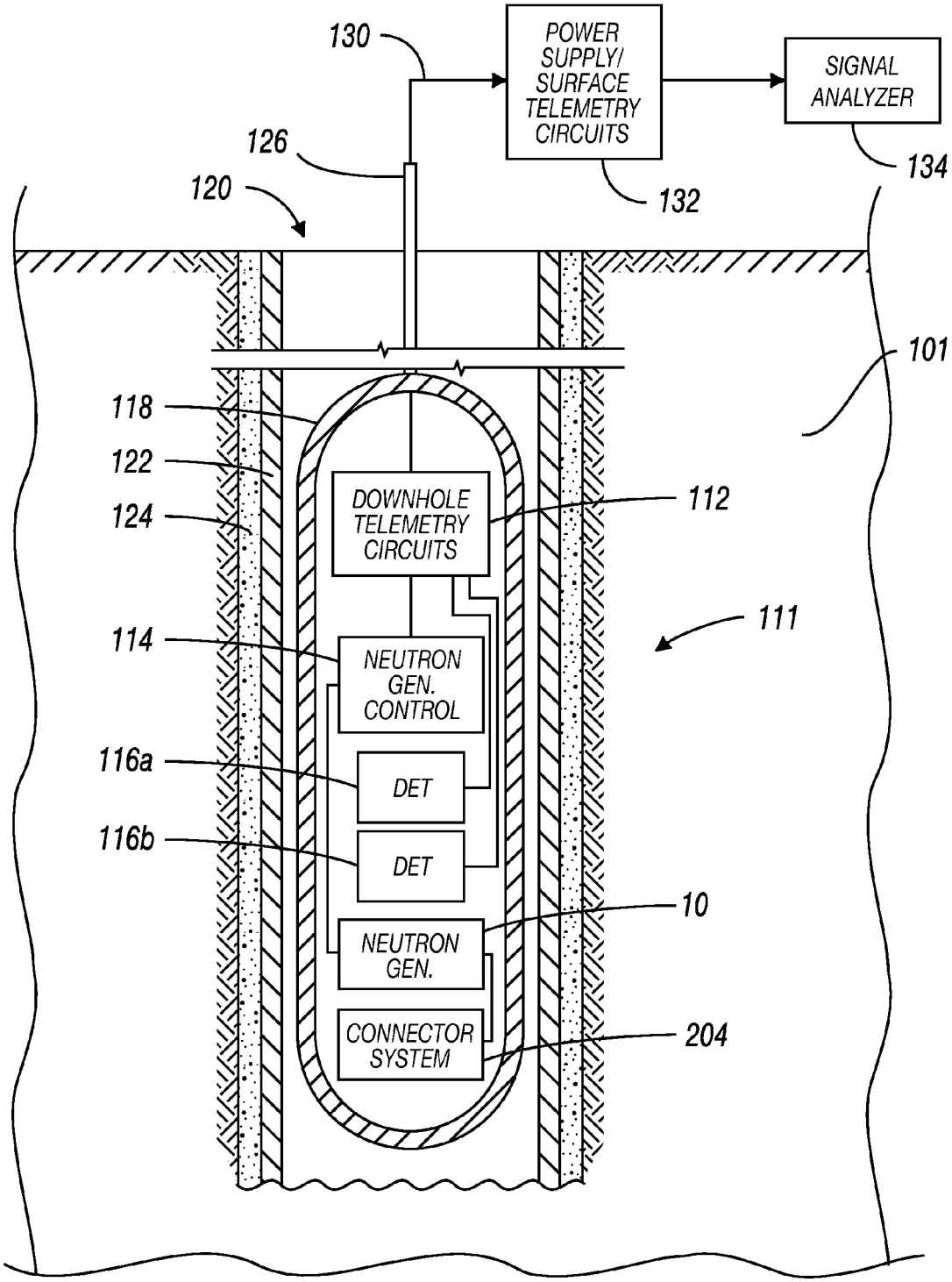
FIG. 1A is a schematic view of a downhole logging tool and associated surface instrumentation.

Referring initially to FIG. 1A, a neutron generator 10 may be used as part of a logging tool 111 as shown. The logging tool 111 may be used in a drilling operation as understood by one of ordinary skill in the art.

The neutron generator 10 may be housed in a sonde 118. The sonde 118 may include electrical components, e.g., downhole telemetry circuits 112, neutron generator control circuitry 114, at least one radiation detector (for example, two shown as 116A, 116B) and possibly other system components are housed within the sonde 118. The sonde 118 may be configured to be drawn through a borehole 120.

The borehole 120 is illustrated as including a steel casing 122 and a surrounding cement annulus 124. The sonde 118, in many situations, is suspended in the borehole 120 by cable, coiled tubing or other means (labeled 126). A multi-conductor power supply cable 130 is carried by the suspension means 126 and provides electrical power from the surface (provided by power supply circuitry 132) downhole to the sonde 118 and the electrical components therein, which include the downhole telemetry circuits 112, neutron generator control circuitry 114, radiation detectors 116A, 116B, and the neutron generator 10.

The neutron generator 10 may comprise the inventive connector system 204 (illustrated with dashed lines in FIG. 1A) described in further detail below. The neutron generator 10 is, in most cases, operated to emit neutrons in order to irradiate the formation adjacent the sonde 118 with such neutrons. Neutrons and/or photons that return from the formation are detected by the radiation detectors 116A, 116B. The output of the radiation detectors 116A, 116B are communicated to the surface by cooperation of downhole telemetry circuitry 112 and surface telemetry circuitry 132, and analyzed by a signal analyzer 134 to obtain information regarding the formation 101.

Oil, gas, water and the elements of the geological formations 101 possess distinctive radiation signatures that permit identification of such geological formations 101. The neutron generator 10 of this disclosure can be used in conjunction with other logging tools, such as those described in U.S. Pat. Nos. 4,794,792; 4,721,853; and 4,600,838; and 5,313,504.

Figure 1B:
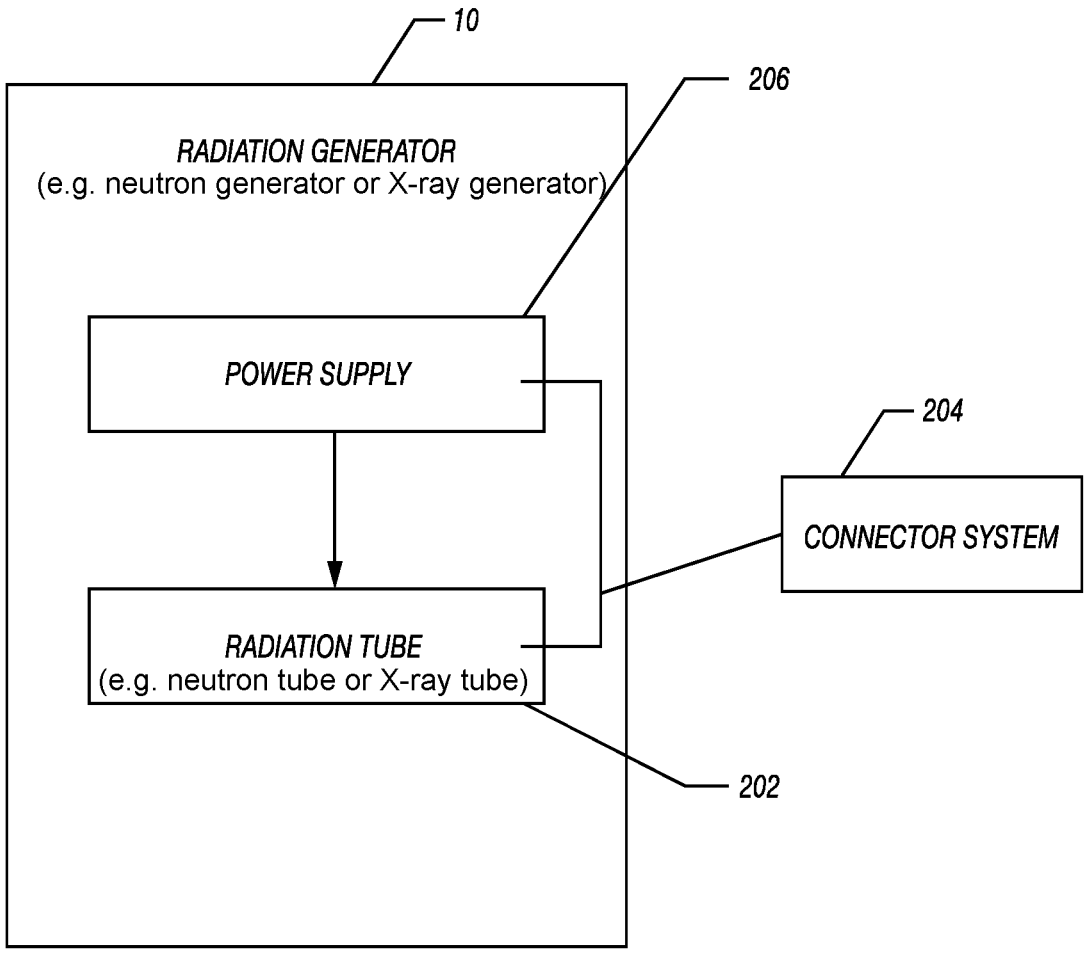
FIG. 1B is a diagram of a neutron generator illustrated in FIG. 1A and which has an inventive connector system.

FIG. 1B is a functional block diagram illustrating a high voltage power supply 206 coupled to a radiation tube 202 utilizing an inventive connector system 204. The connector system 204 along with the high voltage power supply 206 and radiation tube 202 may form the neutron generator 10 as described above.

As noted previously, the power supply 206 and the radiation tube 202 may be manufactured separately and in different locations. The power supply 206 and tube 202 may be coupled by the inventive connector system 204 before these elements are coupled together to form the neutron generator 10 and lowered down into a borehole 120 for a drilling operation.

Figure 2A:
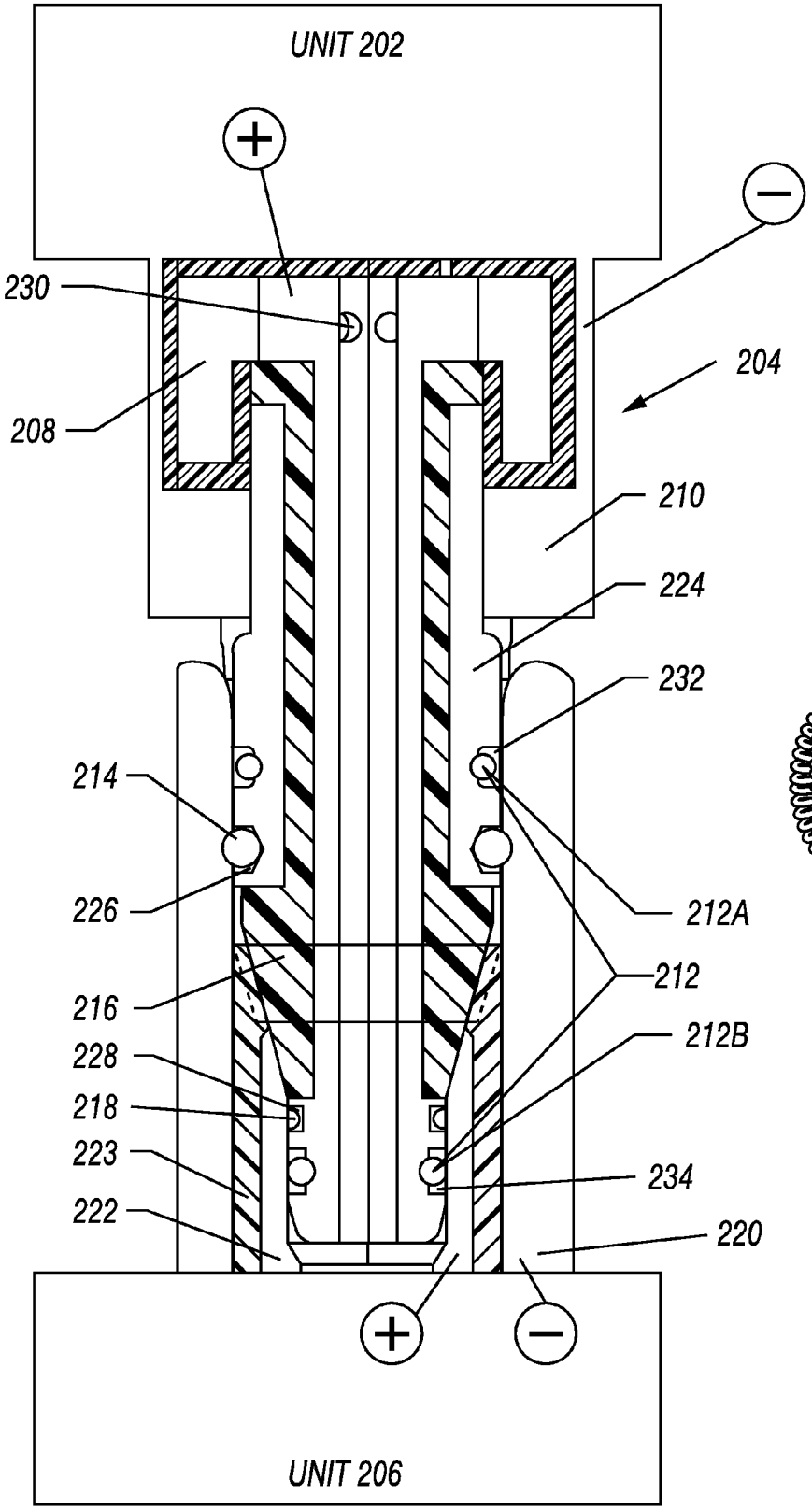
FIG. 2A is a cross-sectional view of one aspect of an inventive connector system that may couple the high voltage power supply and the radiation tube illustrated in FIG. 2A.

FIG. 2A is a cross-sectional view of one aspect of an inventive connector system 204 that may couple the high voltage power supply 206 and the radiation tube 202 illustrated in FIG. 2A. The high voltage power supply 206 referenced in FIG. 2A will be characterized as a second unit 206 while the radiation tube 202 will be characterized as a first unit 202. The reason why these two elements have been generically characterized in this figure is because the inventive connector system 204 is not limited to the types of elements which are coupled together and connector system 204 is also not limited to the direction in which electrical current flows through the system 204.

The first unit 202 may be attached to the center pin 208 and a first outer case 224 of the connector system 204. The center pin 208 may be separated from the first outer case 224 by a first insulating member 216 which circumnavigates a substantial portion or most of the pin 208. The first insulating member 216 may keep the center pin 208 at a different electrical potential relative to a first body portion 210 which is part of the first unit 202.

A first electrical potential or voltage potential having a first polarity, like a negative polarity as indicated with a minus ("−") sign in the drawings, may be supplied to a bottom portion of a receiving cylinder or hollow member 220 of the second unit 206 while a second electrical potential or voltage having a second polarity, like a positive polarity as indicated with a plus ("+") sign in the drawings, may be supplied to the center pin 208. The receiving cylinder 220 which receives and mates with the first outer case 224 both may have a negative polarity as indicated in the drawings.

These potentials provided as illustrated in FIG. 2A may support power and/or bi- directional communications signals as understood by one of ordinary skill in the art. That is, the connector system 204 may support two-way communications signals or powering signals between the first unit 202 and second unit 204, or both.

The second unit 206 may comprise the receiving cylinder 220 which is designed to mate with or receive a second insulating member 223 that is part of the second unit 206. The receiving cylinder or hollow member 220 mates with or receives the first outer case 224. The second insulating member 223 of the second unit 206 may come in direct contact with the first insulating member 216 which surrounds the center pin 208 that is part of the first unit 202. The second unit 206 may further comprise a second outer case 222 (having no shading) made from metal which receives and comes in direct electrical contact with the center pin 208 described above.

The first outer case 224 for the first unit 202 may comprise a first groove 232 that may support a first fluid seal 212A. The first fluid seal 212A may comprise an O-ring. According to one aspect, this first groove 232 may be present in the first outer case 224 and not in the receiving cylinder 220 of the second unit 206. In another aspect (not illustrated), the first groove 232 may be formed in either the outer case 224 or the receiving cylinder 220 or both.

The center pin 208 may comprise a second groove 234 that may support a second fluid seal 212B. The second fluid seal 212B may also comprise an O-ring like the first fluid seal 212A, however, this second fluid seal 212B may have a diameter which is smaller than the diameter of the first fluid seal 212A. The second groove 234 may be present in the center pin 208 and not in the second outer case 222 of the second unit 206. However, according to another aspect (not illustrated), the second groove 234 may be present in either the center pin 209 or in the second outer case 222 or both.

The first outer case 224 of the first unit 202 may further comprise a third groove 226 that supports a first canted coil spring 214. This third groove 226 may be present in both the first outer case 224 of the first unit 202 and the receiving cylinder 220 of the second unit 206. With the third groove 226 present in both the first outer case 224 of the first unit 202 and the receiving cylinder 220 of the second unit 206, then the canted coil spring 214 may provide for a latching contact between these two members.

The center pin 208 of the first unit 202A may further comprise a fourth groove 228 that supports a second canted coil spring 218. However, this second canted coil spring 218 may be designed to provide an electrical contact and not any mechanical latching function. Such a design may be achieved when the fourth groove 228 is present within either of the center pin 208 or the second outer case 222 for the second unit 206. However, one of ordinary skill in the art recognizes that the second canted coil spring 218 may be provided to support a mechanical latching function in other alternative embodiments not illustrated.

The first canted coil spring 214 may provide a first electrical contact and at the same time locks the receiving cylinder 220 of the second unit 206 to the first outer case 224 of the first unit 202. The second, non-latching canted coil spring 218 provides a second electrical contact between the center pin 208 and the conduct of outer case 222 of the second unit 206. Each canted coil spring 214, 218 may comprise an off-the-shelf product, such as, but not limited to, springs sold as of this writing as models of the 10X series as shown in the catalog DM9 by Bal seal Engineering Inc. (of Pauling Foothill Ranch, Calif.).

The two canted coil springs 214, 218 may provide uniform loading when compressed radially or axially. The first canted coil spring 214 may deflect while producing loads which makes the first canted coil spring 214 suitable for latching and holding applications. The sliding/holding and connect/disconnect forces for each canted coil spring 214, 218 may be controlled by designing the grooves 224, 228 holding a respective spring 214, 218 as well as the size of each spring 214, 218, wire diameter of each spring 214, 218, and other spring characteristics to meet special mechanical requirements.

Each canted coil spring 214, 216 may be designed to support the functions of holding, aligning, conducting, shielding and/or completing connections for electrical contacts. Each canted coil spring 214, 216 may support connect/disconnect force ratios ranging from about 1:1 to about 1:10.

As noted previously, the first canted coil spring 214 may fulfill two functions of latching (see groove 226 in both parts—in center pin 208 and outer case 224) and it may serve as an electrical contact. The second and smaller diameter canted coil spring 218 may be used for an electrical contact (in which groove 228 is present in one of the parts which is the center pin 208 and not in the second conductive case 222 of the second unit 206). The latching design described above may have been used for both springs 214, 218, but having just one spring, like first spring 214 serving as the single latching member, may reduce over-constraining of the connector system 204.

Since the first canted coil spring 214 loads the receiving cylinder 206 of the second unit 206 and the outer case 224 of the first unit 202 in a radial manner, this first canted coil spring 214 may center or physically align these two parts. Furthermore, the forces of this spring 214 may counter act against any forces due to shocks which may make the outer case 224 of the first unit 202 and receiving cylinder 220 of the second unit 206 hit or rub each other.

In cases involving acceleration of the units 202, 206 and the connector system 204 such as in an oil drilling context which may defeat the force of the first spring 214, the outer case 224 of the first unit 202 and receiving cylinder 220 of the second unit 206 may still rub and hit each other and possibly create dust and/or particulate matter. To prevent this dust from migrating into areas where it could weaken or damage the system 204, a dual seal 212 comprising O-rings on either side of the springs 214, 218 may effectively trap any particulates/debris.

In a slightly different embodiment, seals 212 may be replaced by overmolded rubber material. In addition to trapping the dust, the seals 212 may complement the springs 214, 218 to absorb any vibrations/shocks.

Therefore, the connector system 204 may move with respect to the power supply 206 and/or the radiation tube 202. Furthermore, in order to be able to unlatch the connector system 204 while disassembling the power supply 206, the power supply 206, in most cases, may need to apply a force on the connector system 204 greater than the latching force of the latching spring 214. The system 204, therefore, has a floating design with limited range. Once the connector system 204 hits the limits of its range of movement, the full force applied to the power supply 206 is transmitted to the connector system 206 and ultimately, to the latching spring 214.

A threaded hole 230 may be used to hold two pieces making up the center pin 208 and also to make up the electrical contact with a wire (not illustrated) originating from the first unit 202. This threaded hole 230 and a corresponding screw (not illustrated) could be removed or replaced with slight variations of the design.

Each of the conductive materials illustrated may be manufactured from metal, such as, but not limited to, steel, aluminum, copper, etc. The conductive materials illustrated in FIG. 2B include the center pin 208; the first and second canted coil springs 214, 218; the first outer case 224; the contact 210; the receiving cylinder 220; and the second outer case 222 for the second unit 206. The non-conductive materials illustrated may be manufactured from conventional dielectric materials such as rubber, plastic, ceramics, and the like. The non-conductive materials illustrated in FIG. 2A have been shaded with thin and thick lines. The non-conductive materials include the first insulating member 216, the second insulating member 224 for the second unit 202, and the seals 212.

Figure 2B:
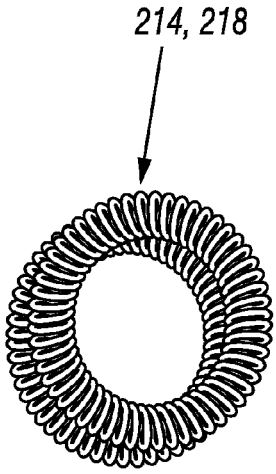
FIG. 2B is a side view of a spring that may be employed in the inventive connector system illustrated in FIG. 2A.

FIG. 2B is a side view of a spring 214, 218 that may be employed in the inventive connector system 204 illustrated in FIG. 2A. As noted above, the springs 214, 218 may comprise canted coil springs. The canted coil springs 214, 218 may provide uniform loading when compressed radially or axially. The canted coil springs 214, 218 are useful embodiment, however, other structures such as, but not limited to, a leaf spring (including fingerstock), or an appropriately shaped round wire spring (polygonal shape, oval shape or other) may be employed without departing from the scope of this disclosure.

Figure 2C:
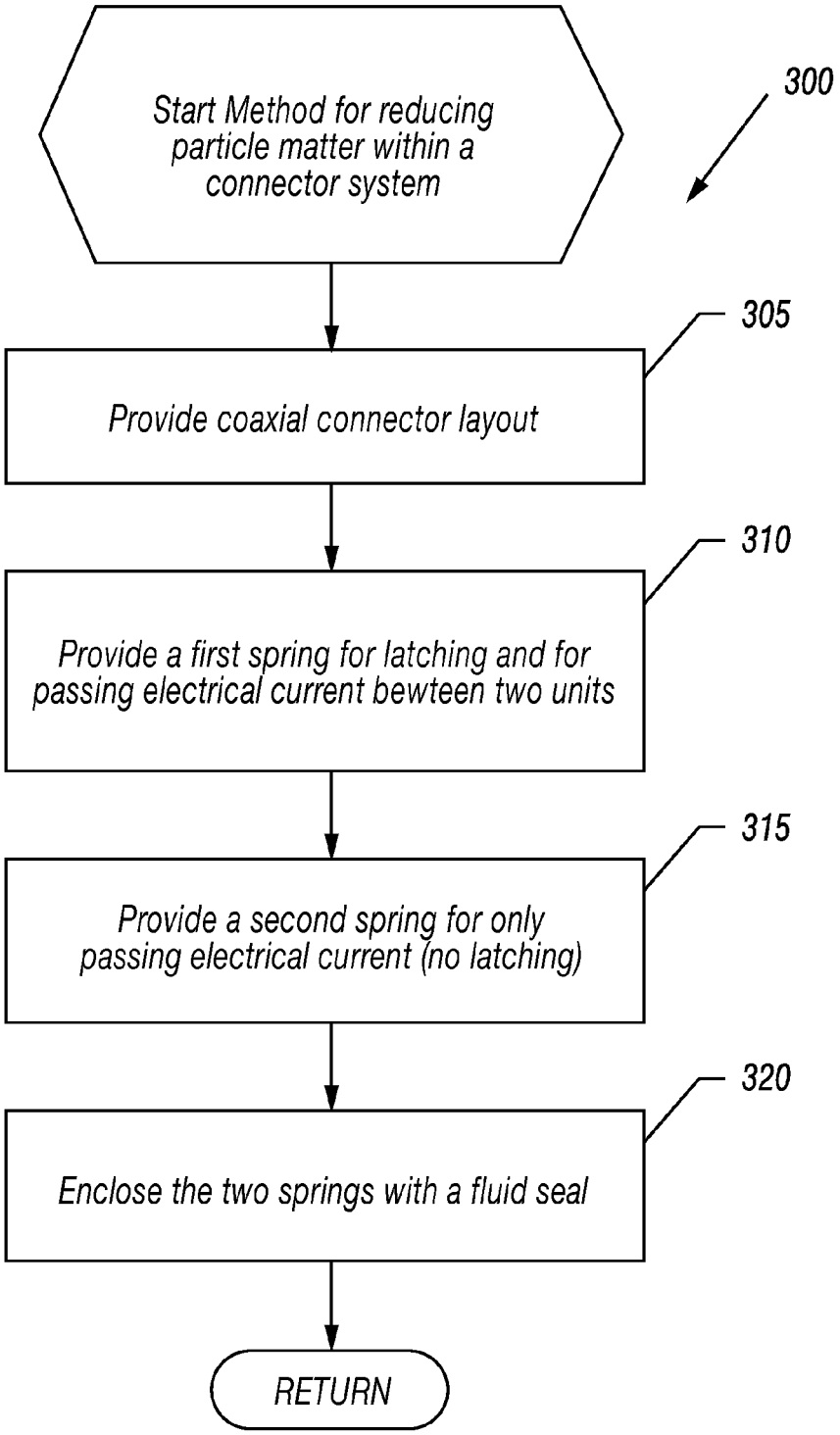
FIG. 2C is a flow chart illustrating a method for reducing and/or eliminating particulate matter in connector systems for a wellsite drilling operation.

FIG. 2C is a flow chart illustrating a method 300 for reducing and/or eliminating particulate matter in connector systems 204 for a wellsite drilling operation. Block 305 is the first block of method 300. In block 305, a coaxial connector layout may be provided such as illustrated in FIG. 2A described above. Next, in block 310, a first spring 214 may be provided for latching and as an electrical contact. Subsequently, in block 315, a second spring 218 may be provided to supply an electrical contact and not any latching function as described above in connection with FIG. 2A. This electrical current may comprise power signals or communication signals or both. In block 320, the two springs 214, 218 may be enclosed with a fluid seal 212 in order to substantially reduce the flow of particulate matter created during vibration of the connector system 204 as described above. The method 300 then ends.

With this inventive connector system 204 and method 300, high-voltage contacts may be supported in which the electrical contacts must remain together for long periods of time. The inventive connector system 204 and method 300 may compensate for any thermal expansion mismatch between the different elements (i.e., such as the radiation tube 202, and housing for the high voltage power supply 206.

The inventive connector system 204 and method 300 may endure environmental abuse in an oil drilling context (such as shock vibration, high and low temperature, thermal cycling, etc.). The inventive connector system 204 and method 300 may be designed to fit within a very limited space while also eliminating or substantially reducing any corona discharge.

With the inventive connector system 204 method 300, assembly and disassembly of the units 202, 206 being connected may be accomplished very easily.

Certain steps in the processes or process flows described in this specification naturally precede others for the system and method to function as described. However, the system and method are not limited to the order of the steps described if such order or sequence does not alter the functionality of the system or method. That is, it is recognized that some steps may be performed before, after, or in parallel (substantially simultaneously with) other steps without departing from the scope and spirit of the disclosure. In some instances, certain steps may be omitted or not performed without departing from the system or method. Further, words such as "thereafter", "then", "next", etc. are not intended to limit the order of the steps. These words are simply used to guide the reader through the description of the sample methods described herein.

Although only a few embodiments have been described in detail above, those skilled in the art will readily appreciate that many modifications are possible in the embodiments without materially departing from this system or method.

For example, a coaxial and cylindrical arrangement are illustrated in FIG. 2A. The geometrical shape for several members of the system 224 may be different than what is illustrated. That is, the shape for the receiving cylinder/hollow member 220 could be oval or square on the outside and contain two or more inner connections that are shaped to match the first outer case 224, which could remain to have a cylindrical shape.

Also, while only a single connector system 224 is illustrated in FIG. 2A, multiple systems 224 may be used in parallel with one another between the two units 202, 206. Further, multiple inner connections, such as the outer case 224 and center pin 208, could be nested coaxially, be put side-by-side, or arranged in a pattern as understood by one of ordinary skill in the art.

Accordingly, all such modifications are intended to be included within the scope of this disclosure as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, sixth paragraph for any limitations of any of the claims herein, except for those in which the claim expressly uses the words 'means for' together with an associated function.

What is claimed is:

1. A breakable coupling mechanism comprising:
- a center pin supporting a first electrical potential;
- an outer case supporting a second electric potential different from the first electric potential;
- a hollow member for receiving the outer case;
- a fluid seal between the outer case and the hollow member; and
- a spring surrounding the outer case and positioned between the hollow member and the outer case for conducting a signal and which permits movement of the outer case relative to the hollow member, the spring comprising a canted coil spring for supporting load forces and for passing electrical current.

2. The coupling mechanism of claim 1, wherein the signal supplies at least one of communication and power.

3. The coupling mechanism of claim 1, wherein the spring is a first spring, coupling mechanism further comprising a second spring surrounding the center pin.

4. The coupling mechanism of claim 1, wherein the spring rests in a groove that is formed by the outer case and the hollow member.

5. The coupling mechanism of claim 1, wherein the center pin, the outer case, the hollow member, and spring are made from metal.

6. The coupling mechanism of claim 1, wherein the outer case comprises a groove and a seal for preventing fluid from moving between the hollow member and the outer case.

7. A connector system for reducing particulate matter within the system comprising:
- a first unit;
- a second unit;
- a breakable coupling positioned between the first unit and second unit comprising:
  - a center pin attached to the first unit and having a first potential;
  - an outer case attached to the first unit and having a second potential different from the first potential;
  - a fluid seal surrounding the outer case;
  - a spring surrounding the outer case and for engaging the second unit and for passing a signal between the first unit and the second unit.

8. The connector system of claim 7, wherein the signal supplies at least one of communication and power between the first and second units.

9. The connector system of claim 7, wherein the first unit and second unit are part of an oil drilling system.

10. The connector system of claim 7, wherein the fluid seal is dispositioned between the outer case and a receiving cylinder of the second unit.

11. The connector system of claim 7, wherein the fluid seal is dispositioned in a groove formed in the outer case and a receiving cylinder of the second unit.

12. The connector system of claim 7, wherein the fluid seal is an O-ring.

13. The connector system of claim 7, wherein the spring comprises a canted coil spring for supporting load forces and for passing electrical current.

14. The connector system of claim 13, wherein the spring rests in a groove that is formed by the outer case and a receiving cylinder of the second unit.

15. The connector system of claim 7, wherein the spring is a first spring, the system further comprising a second spring surrounding the center pin and for engaging the second unit.

16. The connector system of claim 15, wherein the second spring rests in a groove that is formed in the center pin.

17. The connector system of claim 7, wherein the first unit comprises a radiation generator and the second unit comprises a power supply.

18. The connector system of claim 17, wherein the radiation generator comprises at least one of a neutron tube and an x-ray tube.

* * * * *